US011741888B2

(12) United States Patent
Huang

(10) Patent No.: US 11,741,888 B2
(45) Date of Patent: Aug. 29, 2023

(54) LED DISPLAY DEVICE, DRIVING METHOD AND CHIP THEREOF

(71) Applicant: Chipone Technology (Beijing) Co., Ltd., Beijing (CN)

(72) Inventor: Zhizheng Huang, Beijing (CN)

(73) Assignee: CHIPONE TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 17/778,795

(22) PCT Filed: Feb. 21, 2020

(86) PCT No.: PCT/CN2020/076105

§ 371 (c)(1),
(2) Date: May 20, 2022

(87) PCT Pub. No.: WO2021/098068

PCT Pub. Date: May 27, 2021

(65) Prior Publication Data

US 2022/0415246 A1 Dec. 29, 2022

(30) Foreign Application Priority Data

Nov. 20, 2019 (CN) ..... 201911141020.X

(51) Int. Cl.
*G09G 3/32* (2016.01)

(52) U.S. Cl.
CPC ..... *G09G 3/32* (2013.01); *G09G 2310/0291* (2013.01); *G09G 2320/0271* (2013.01)

(58) Field of Classification Search
CPC ..... G09G 3/32; G09G 2310/0291; G09G 2320/0271; G09G 3/3275; G09G 2310/08;
(Continued)

(56) References Cited

U.S. PATENT DOCUMENTS 11,073,941 B1 * 7/2021 Wu ..... G09G 3/3233
2008/0088571 A1 * 4/2008 Lee ..... G09G 3/3406 345/102

(Continued)

FOREIGN PATENT DOCUMENTS

CN 102281665 12/2011
CN 102592542 7/2012

(Continued)

*Primary Examiner* — Andrew Sasinowski
(74) *Attorney, Agent, or Firm* — Treasure IP Group, LLC

(57) ABSTRACT

Disclosed is an LED display device, a driving method and a chip thereof. The LED display device comprises: a display array comprising row lines, column lines, and pixel units each comprising an LED connected to a corresponding one of the row lines and a corresponding one of the column lines; a row driver module, connected to the row lines and providing selection signals; a column driver module, connected to the column lines and providing driving signals corresponding to gray scale data according to pulse width modulation signals; a channel control module, connected to the column lines and adjusting a column-line voltage of a corresponding column line to a target voltage in a first time period when a corresponding pulse width modulation signal is active, thus improving constant current cut-in speed and improve consistency and linearity under low gray scale when an image with low gray scale is displayed.

8 Claims, 4 Drawing Sheets

(58) Field of Classification Search
CPC .. G09G 3/3216; G09G 5/10; G09G 2320/064; G09G 2230/00; G09G 2310/06; G09G 2330/021; H05B 45/325
See application file for complete search history.

(56) References Cited

U.S. PATENT DOCUMENTS

| | | | | |
|---|---|---|---|---|
| 2016/0148578 | A1* | 5/2016 | Kishi | G09G 3/3291 345/212 |
| 2017/0186364 | A1* | 6/2017 | Okamoto | H01L 27/1225 |
| 2018/0013421 | A1* | 1/2018 | Park | G11C 19/28 |
| 2019/0385512 | A1* | 12/2019 | Lee | G09G 3/32 |
| 2021/0166618 | A1* | 6/2021 | Baumheinrich | G09G 3/2077 |
| 2021/0360766 | A1* | 11/2021 | Qu | H05B 47/19 |

FOREIGN PATENT DOCUMENTS

| | | |
|---|---|---|
| CN | 104392698 | 3/2015 |
| CN | 105374317 | 3/2016 |
| CN | 105938703 | 9/2016 |
| CN | 106251806 | 12/2016 |
| CN | 107749272 | 3/2018 |

* cited by examiner

LED DISPLAY DEVICE, DRIVING METHOD AND CHIP THEREOF

CROSS-REFERENCE TO RELATED APPLICATION

This application is a Section 371 National Stage application of International Application No. PCT/CN2020/076105, which is filed on Feb. 21, 2020 and published as WO2021/098068, on May 27, 2021, not in English, which claims priority to a Chinese patent application No. 201911141020.X, filed on Nov. 20, 2019, entitled "LED display device, driving method and chip thereof", and published as CN110853570A on Feb. 28, 2020, the entire contents of which are incorporated by reference in their entireties.

FIELD OF THE DISCLOSURE

The present disclosure relates to a technical field of display, and more particularly, to an LED display device, a driving method of an LED display device and a chip of an LED display device.

DESCRIPTION OF THE RELATED ART

A light-emitting diode (LED) is a diode that exploits light-emitting principle of recombining minority carriers and majority carriers in a PN junction. When a forward voltage is applied to the PN junction, the diode can be turned on, so that electrical energy can be converted into optical energy. An LED display device is a display device using an LED as a pixel unit, wherein the luminance of the LED corresponds to a gray scale to be displayed.

LED display devices are different from liquid crystal display devices. In a liquid crystal display device, light transmittance of each pixel unit is changed by rotating liquid crystal molecules in a liquid crystal molecular layer, so that the intensity of light generated by a backlight source changes after passing through the liquid crystal molecular layer. While, in an LED display device, the display gray scale is changed by controlling the luminance of the light source itself. Compared with liquid crystal display devices, LED display devices have low power consumption, fast refresh speed and wide viewing angle, and can be used in strong illumination environment and low temperature environment. Therefore, LED display devices are particularly suitable for being used as an outdoor display screen for displaying texts, images and videos.

In a traditional LED display screen, a constant current source driven by a pulse width modulation signal is used to drive LED. Due to physical characteristics of an LED, when the LED is turned on, the luminance of that LED is related to a value of a corresponding driving current. Furthermore, by controlling a duty cycle of the corresponding pulse width modulation signal, an effective turn-on time period of the LED can be adjusted, thereby changing the luminance of the LED.

However, with the decrease of pixel spacing and the increase of integration level of the LED display screen, when an image with low gray scale is displayed, the speed of turning on a channel for PWM constant current driving will decrease, which will lead to deterioration on gray-scale linearity and consistency when the image with low gray scale is displayed, and affect display effect of the image with low gray scale.

SUMMARY OF THE DISCLOSURE

In view of this, an objective of the present invention is to provide an LED display device, a driving method, and a chip thereof, which can adjust a column-line voltage of each column line to a target voltage in a first time period when a corresponding pulse width modulation signal is active, thus, when an image with low gray scale is displayed, constant current cut-in speed and linearity under low gray scale can be improved.

According to a first aspect of an embodiment of the present disclosure, an LED display device is provided, and comprises: a display array, comprising a plurality of row lines, a plurality of column lines, and a plurality of pixel units, wherein each of the plurality of pixel units comprises an LED connected to a corresponding one of the plurality of row lines and a corresponding one of the plurality of column lines; a row driver module connected to the plurality of row lines and configured to provide selection signals to the plurality of row lines, respectively; a column driver module, which is connected to the plurality of column lines and configured to provide driving signals corresponding to gray scale data according to pulse width modulation signals, respectively; and a channel control module connected with the plurality of column lines, wherein, the channel control module is configured to adjust a column-line voltage of a corresponding one of the plurality of column lines to a target voltage in a first time period when a corresponding one of the pulse width modulation signals is active.

In some embodiments, the column driver module is configured to control a constant current source to provide a driving current in a second time period after the first time period, such that LEDs which are comprised by the plurality of LEDs and connected to a corresponding one of the plurality of column lines are turned on to produce luminance corresponding to the gray scale data.

In some embodiments, the channel control module comprises: a plurality of buffer amplifiers, each of which comprises a non-inverting input terminal for receiving the target voltage, an inverting input terminal connected to a corresponding one of the plurality of column lines, an output terminal connected to the inverting input terminal, and an enabling terminal for receiving an enabling signal.

In some embodiments, the channel control module further comprises a target voltage generation unit, configured to set the target voltage of the plurality of column lines according to a predetermined value.

In some embodiments, the channel control module further comprises: a voltage detection unit which is connected to the plurality of column lines, and configured to obtain a minimum cut-in voltage of each of the plurality of column lines; and a target voltage generation unit, configured to respectively set the target voltage of each of the plurality of column lines according to the minimum cut-in voltage of a corresponding one of the plurality of column lines.

In some embodiments, the channel control module further comprises a timing generator, configured to generate the enable signal, which is synchronized with the pulse width modulation signal corresponding to of each of the plurality of column lines.

The display array comprises an LED display array, an AMOLED display array, a MicroLED or a MiniLED display array.

According to a second aspect of an embodiment of the present disclosure, a driving method of an LED display device is provided, wherein the LED display device comprises a plurality of row lines, a plurality of column lines and a plurality of pixel units, each of the plurality of pixel units comprises an LED connected to a corresponding one of the plurality of row lines and a corresponding one of the plurality of column lines, wherein the driving method comprises: generating gray scale data according to an image to be displayed; generating pulse width modulation signals according to the gray scale data; and in adjusting a column-line voltage of a corresponding one of the plurality of column lines to a target voltage in a first time period when a corresponding one of the pulse width modulation signals is active.

In some embodiments, the driving method further comprises: controlling constant current sources to provide driving currents in accordance with the pulse width modulation signals in a second time period after the first time period, respectively, so that LEDs which are comprised by the plurality of LEDs and connected to a corresponding one of the plurality of column lines are turned on to produce luminance corresponding to the gray scale data.

According to a third aspect of an embodiment of the present disclosure, a chip of an LED display device is provided, wherein the chip comprises at least one of the row driver module, the column driver module and the channel control module described above.

The LED display device according to embodiments of the present disclosure comprises a channel control module, configured to pre-charge each column line in the first time period when the corresponding pulse width modulation signal is active, and adjust the column-line voltage of each column line to the target voltage, thus, when an image with low gray scale is displayed, constant current cut-in speed and linearity under low gray scale can be improved.

In an alternative embodiment, the buffer amplifiers in the channel control module can be realized by a circuit structure inside a constant current driver chip without adding additional circuit cost and increasing power consumption.

In an alternative embodiment, the channel control module is configured to respectively set the target voltage of each column line according to the minimum cut-in voltage that can be achieved when that column line provides stable output, thereby further compensating for consistency under a situation that an image with low gray scale is displayed.

BRIEF DESCRIPTION OF THE DRAWINGS

The above and other objectives, features and advantages of the present invention will become more apparent from the following description of embodiments of the present disclosure, with reference to the accompanying drawings, in which.

DETAILED DESCRIPTION OF EMBODIMENTS OF THE DISCLOSURE

Figure 1:
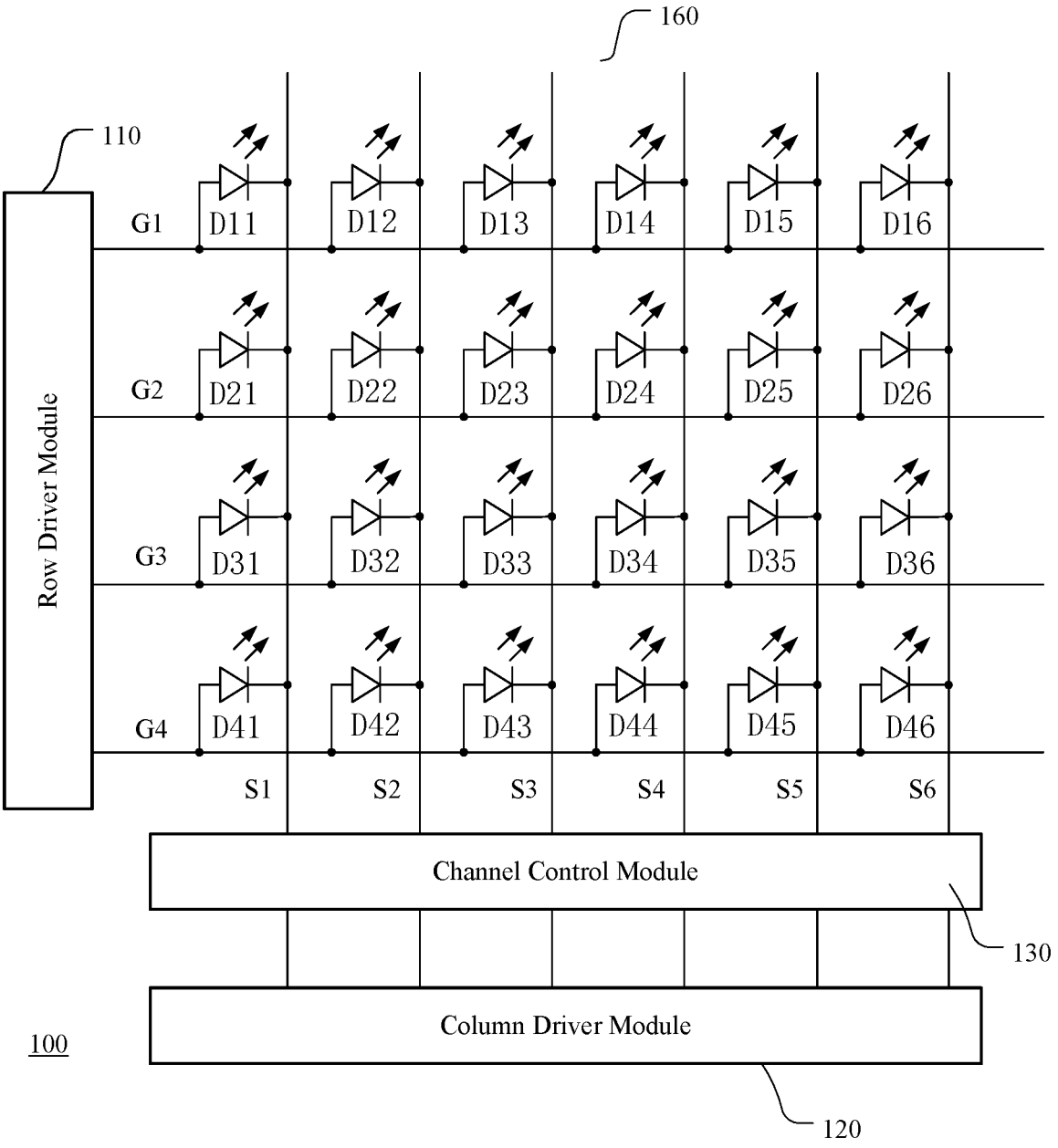
FIG. 1 shows a schematic structural diagram of an LED display device according to an embodiment of the present disclosure.

The present invention will be described in more detail below with reference to the accompanying drawings. Throughout the various figures, like elements are denoted by like reference numerals. For the sake of clarity, various parts in the drawings are not drawn to scale. In addition, some well-known parts may not be shown in the figures.

Hereinafter, many specific details of the present invention, such as a structure, material, a dimension, a processing process and technique of the device are described, in order to make the present invention clearly understood. However, as will be understood by those skilled in the art, the present invention may be practiced without these specific details.

FIG. 1 shows a schematic structural diagram of an LED display device according to an embodiment of the present disclosure. The LED display device 100 comprises a row driver module 110, a column driver module 120, a channel control module 130 and a display array 160.

The display array 160 may comprise an LED (light-emitting diode) display array, an AMOLED (active-matrix organic light-emitting diode) display array, a MicroLED or a MiniLED display array.

For instance, the display array 160 comprises a plurality of LEDs arranged in rows and columns. As an example, the display array 160 with 4 rows*6 columns is shown in FIG. 1. Each LED has an anode and a cathode, and can be turned on when a forward voltage is applied between the anode and the cathode. Anodes of a plurality of LEDs arranged in a same row are commonly connected to a same row line, for example, anodes of LEDs D11-D16 in a first row are commonly connected to a corresponding row line G1. Cathodes of a plurality of LEDs in a same column are commonly connected to a same column line, for example, cathodes of LEDs D11-D41 in a first column are commonly connected to a corresponding column line S1.

The row driver module 110 is connected to a plurality of row lines G1-G4 for providing selection signals to the plurality of row lines, respectively. The row driver module 110 internally comprises a plurality of selector switches, each of which is connected to a corresponding one of the plurality of row lines. When one of the plurality of selector switches is turned on, the corresponding row line can be connected to a high voltage potential terminal via that one of the plurality of selector switches.

The column driver module 120 is connected to a plurality of column lines S1-S6 for providing drive signals corresponding to gray scale data. The column driver module 120 internally comprises a plurality of constant current sources connected to the plurality of column lines, respectively. When a plurality of LEDs in a same row are selected by the row driver module 110, as described above, anodes of the plurality of LEDs in that same row are connected to a high voltage potential and cathodes of the plurality of LEDs in that same row are respectively connected to the corresponding constant current sources, thereby a forward voltage is applied between the anode and the cathode of each one of the plurality of LEDs in that same row, so that the plurality of LEDs in that same row can be turned on.

The channel control module 130 is connected to the plurality of column lines S1-S6. The channel control module 130 is configured to pre-charge parasitic capacitance between a corresponding column line and each one of the plurality of row lines in a first time period when a corresponding one of the pulse width modulation signals, which respectively correspond to the plurality of column lines S1-S6, is active, and adjust s column-line voltage of that corresponding column line to a target voltage. The column driver module 120 then controls the constant current sources to provide driving currents according to the pulse width modulation signals in a second time period after the first time period, so that the LEDs connected to the column lines S1-S6 can be turned on.

In the LED display device 100 described above, the plurality of LEDs in the display array 160 serve as pixel units, respectively. It should be understood that each pixel in the LED display device 100 may include one or more pixel units. For example, when a color image is displayed, three LEDs can be used to display color components of red, green and blue, respectively, and each LED can produce light with a corresponding color according to its own luminous characteristics, or an additional optical filter can be used to produce light with a corresponding color.

While the LED display device 100 displays a dynamic image, the row driver module 110 is, for example, configured to sequentially connects the plurality of row lines to high voltage level by scanning row by row. Accordingly, the plurality of constant current sources in the column driver module 120 respectively apply constant currents to a plurality of LEDs connected to the corresponding row under scanning. The column driver module 120 is configured to control the duty cycle of each pulse width modulation signal according to the gray scale data of the corresponding row of the image, thereby changing the effective turn-on time period of the plurality of LEDs connected to the corresponding row line, thereby adjusting the luminance of the plurality of LEDs connected to the corresponding row line, so that the image can be displayed.

In some other embodiments, the LED display device 100 may comprise a driver chip integrated with at least one of the row driver module 110, the column driver module 120, and the channel control module 130 described above.

Figure 2:
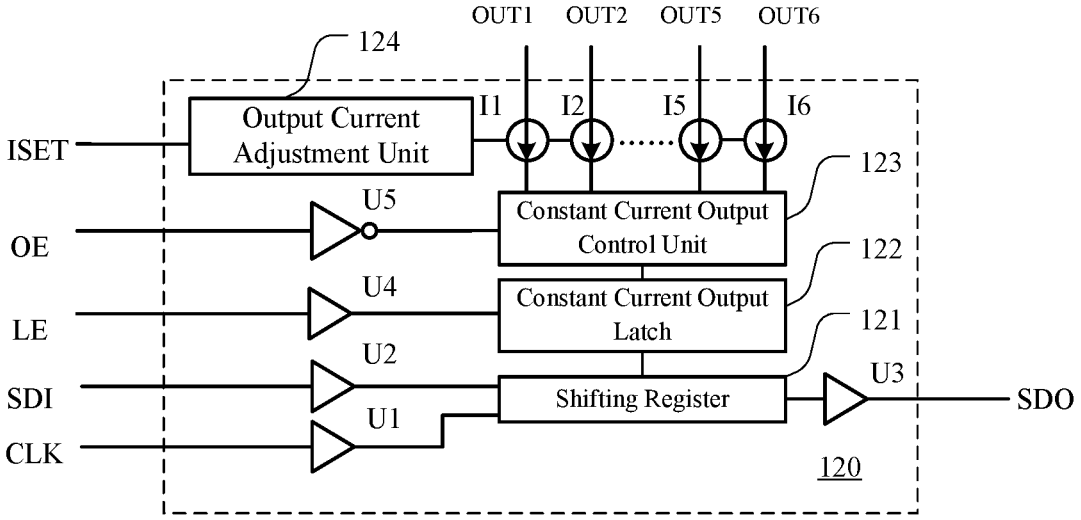
FIG. 2 shows a schematic circuit diagram of a column driver module in the LED display device shown in FIG. 1.

FIG. 2 shows a schematic circuit diagram of the column driver module in the LED display device as shown in FIG. 1. The column driver module 120 is a constant current driver module that is configured to generate constant currents as outputs according to serial data.

The column driver module 120 comprises a shift register 121, a constant current output latch 122, a constant current output control unit 123, an output current adjustment unit 124, a plurality of constant current sources I1-I6, buffers U1-U4, and an inverter U5.

The shift register 121 is configured to receive a clock signal CLK and serial input data SDI via the buffers U1 and U2, respectively. For example, at a rising edge of the clock signal CLK, the shift register 121 performs shifting. The shift register 121 is configured to provide serial output data SDO via the buffer U3.

The constant current output latch 122 is connected to the shift register 121 and is configured to receive a latch enable signal LE via the buffer U4. When the latch enable signal LE is active, the constant current output latch 122 is configured to receive serial data from the shift register 121. When the latch enable signal LE is inactive, the constant current output latch 122 is configured to latch the serial data that has been received.

The constant current output control unit 123 is connected to the constant current output latch 122 and is configured to receive a strobe enable signal OE via the inverter U5. A plurality of output terminals OUT1-OUT6 are configured to provide constant current outputs when the strobe enable signal OE is inactive. When the strobe enable signal OE is active, the plurality of output terminals OUT1-OUT6 are turned off, so as not to provide the constant current outputs.

The plurality of constant current sources I1-I6 are connected to the constant current output control unit 123. The constant current output control unit 123 is configured to generate pulse width modulation signals each having a duty cycle corresponding to the serial data, and control turn-on states of the plurality of constant current sources I1-I6, respectively, thereby changing the effective turn-on time periods of the LEDs.

The output current adjustment unit 124 is configured to receive a current setting signal ISET for setting current values of the plurality of constant current sources I1-I6. The current setting signal ISET can be generated by an external resistor.

In this embodiment, the shift register 121 is configured to provide the serial output data SDO, so that the plurality of column driver modules 120 can be connected in series with each other. Although a number of output terminals of each LED constant current driver module is limited, more output terminals may be provided by connecting several column driver modules 120 in series to drive a corresponding number of column lines.

Figure 3:
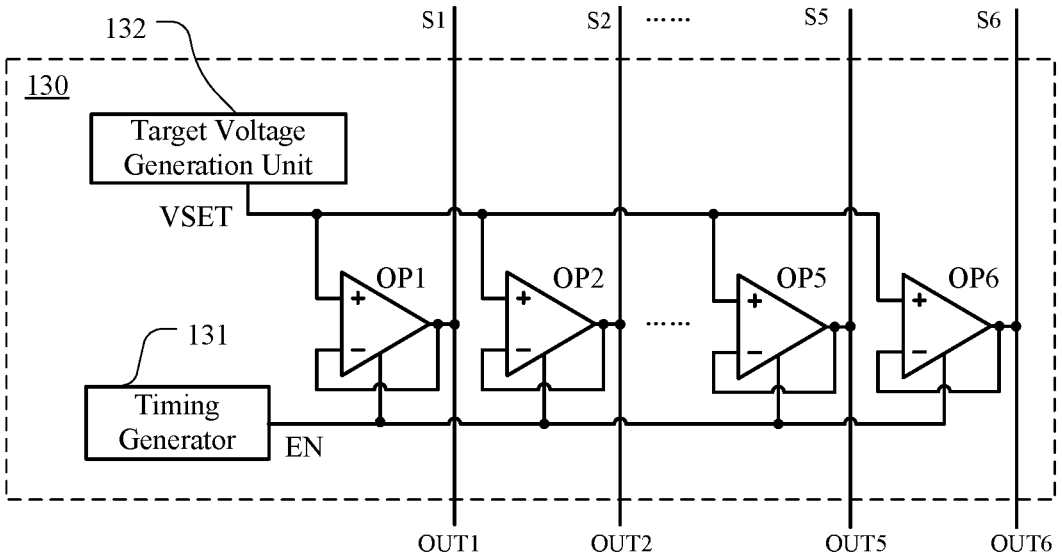
FIG. 3 shows a schematic circuit diagram of a channel control module in the LED display device shown in FIG. 1.

FIG. 3 shows a schematic circuit diagram of the channel control module in the LED display device as shown in FIG. 1. The channel control module 130 comprises a plurality of buffer amplifiers OP1-OP6, a timing generator 131, and a target voltage generation unit 132.

In this embodiment, the plurality of buffer amplifiers OP1-OP6 each comprise a non-inverting input terminal, an inverting input terminal, an output terminal and an enable terminal. The non-inverting input terminals of the plurality of buffer amplifiers OP1-OP6 are connected to the target voltage generation unit 132 to receive the target voltage VSET, the inverting input terminal and the output terminal of each one of the plurality of buffer amplifiers are connected to a corresponding one of the plurality of column lines, and the enabling terminals of the plurality of buffer amplifiers OP1-OP6 are connected to the timing generator 131. As described above, first ends of the column lines S1-S6 as shown in FIG. 3 are respectively connected to the plurality of output terminals OUT1-OUT6 of the column driver module 120, and second ends of the column lines S1-S6 as shown in FIG. 3 are respectively connected to corresponding LEDs. The timing generator 131 is configured to generate the enable signal EN which is synchronized with the pulse width modulation signals. When the enable signal EN is active, the plurality of buffer amplifiers OP1-OP6 are turned on; when the enable signal EN is inactive, the plurality of buffer amplifiers OP1-OP6 are turned off.

In this embodiment, the target voltage generation unit 132 is implemented by, for example, a digital-to-analog converter (DAC), and is configured to generate the target voltage VSET according to a received digital signal representing the minimum cut-in voltage that can be achieved when the plurality of column lines are operated under stable condition.

Figure 4:
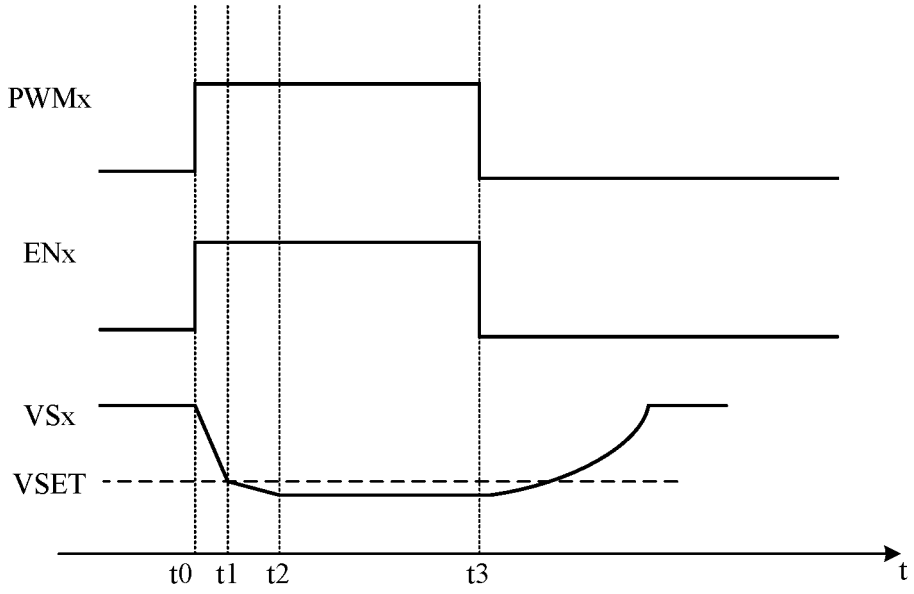
FIG. 4 shows a schematic waveform diagram of signals for LED driving according to an embodiment of the present disclosure.

FIG. 4 shows a schematic waveform diagram of signals for LED driving according to an embodiment of the present disclosure. In FIG. 4, PWMx, ENx, and VSx, which change over time, denote the pulse width modulation signal of the x-th channel, the enable signal of the x-th channel, and the column-line voltage on the x-th channel, respectively.

It should be noted that, in the LED display device 100 according to the this embodiment, a pre-charging time period and a constant current charging time period are divided within the effective turn-on time period of an LED. During the pre-charging time period, the channel control module 130 is configured to pull the column-line voltages of the plurality of column lines S1-S6 to the target voltage; during the constant current charging time period, the column driver module 120 is configured to control the constant current sources to perform constant current charging on the plurality of column lines S1-S6 according to the pulse width modulation signals, respectively, so that the LEDs connected to the plurality of column lines S1-S6 can be turned on.

As described above, the timing generator 131 in the channel control module 130 is configured to generate one or more enable signal EN each of which is synchronized with a corresponding one of the pulse width modulation signals. In this embodiment, the pulse width modulation signals and the enable signal EN are active at high voltage level and inactive at low voltage level.

Figure 5:
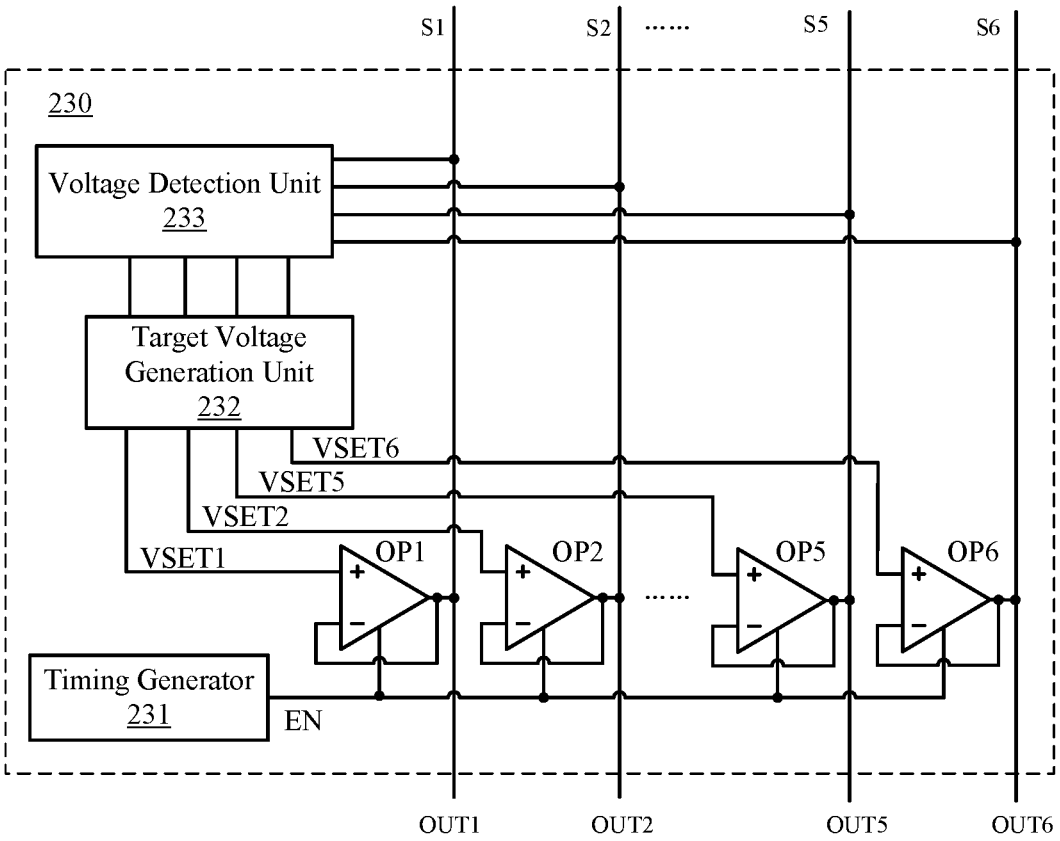
FIG. 5 shows another schematic circuit diagram of a channel control module in the LED display device shown in FIG. 1.

According to the embodiment shown in FIG. 5, the pre-charging time period and the constant current charging time period are divided within the effective turn-on time of an LED. For example, the effective turn-on time of the LED is from time t0-t3 and is divided to comprise the pre-charging time period from time t0-t1 and the constant current charging time period from time t1-t2.

At time t0, the pulse width modulation signal PWMx and the enable signal ENx are simultaneously flipped to active state, the buffer amplifier OPx in the channel control module 130 is turned on, the buffer amplifier OPx is configured to supply a current for charging and discharging according to a voltage difference between the column-line voltage VSx of the corresponding column line and the target voltage VSET. When the column-line voltage VSx is greater than the target voltage VSET, the buffer amplifier OPx is configured to discharge the column line and pull the column-line voltage of that column line to low voltage level.

At time t1, the buffer amplifier OPx is configured to pull the column-line voltage VSx of the corresponding column line to a voltage close to the target voltage VSET, the column-line voltage VSx is lower than the target voltage VSET, and the buffer amplifier OPx is turned off. In this embodiment, the target voltage VSET is slightly larger than the minimum cut-in voltage of each channel, so the circuit is restored as a constant current source driving circuit, and the column driver module 120 is configured to control the corresponding constant current source to provide the corresponding driving current according to the pulse width modulation signal PWMx, to further pull the column-line voltage VSx down.

At time t2, the column-line voltage VSx is pulled down to the minimum cut-in voltage of the x-th channel, the x-th channel is effectively turned on, and a plurality of LEDs connected to the column line Sx are turned on. Until time t3, the effective turn-on time period of the column line Sx is completed.

FIG. 5 shows another schematic circuit diagram of the channel control module in the LED display device as shown in FIG. 1. In an alternative embodiment, the channel control module 230 comprises a timing generator 231, a target voltage generation unit 232 and a voltage detection unit 233. The voltage detection unit 233 is implemented by, for example, an analog-to-digital converter (ADC). The voltage detection unit 233 is connected to the plurality of column lines S1-S6, and is configured to detect a minimum cut-in voltage of each column line that can be achieved when that column line has stable output, and output digital signals representing the minimum cut-in voltages of the plurality of column lines, respectively. The target voltage generation unit 232 is implemented by, for example, a digital-to-analog converter (DAC), and is connected to the voltage detection unit 233 to respectively set the target voltages of the plurality of column lines S1-S6 according to the digital signals representing the minimum cut-in voltages acquired by the voltage detection unit 233. To this end, the target voltage generation unit 232 has a plurality of input terminals for receiving the minimum cut-in voltages and a plurality of output terminals for providing the plurality of target voltages VSET1-VSET6, each output terminal is connected to the non-inverting input terminal of a corresponding one of the buffer amplifiers, so that gray-scale linearity and consistency under a situation that an image with low gray scale is displayed can be further compensated.

It should be noted that, in the above embodiment, the LED display device with common anode structure is described as an example, however, the channel control module according to embodiments of the present disclosure is also applicable to an LED display device with common cathode structure, so as to adjust the column-line voltage of each column line to the corresponding target voltage in the first time period when the pulse width modulation signal is active, thereby improving the constant current cut-in speed when an image with low gray scale is displayed.

To sum up, the LED display device according to embodiments of the present disclosure comprises a channel control module, configured to pre-charge each column line in the first time period when the pulse width modulation signal is active, and adjust the column-line voltage of each column line to the target voltage, thus, when an image with low gray scale is displayed, the constant current cut-in speed and the linearity under low gray scale can be improved.

In an alternative embodiment, the buffer amplifiers in the channel control module can be realized by a circuit structure inside a constant current driver chip without adding additional circuit cost and increasing power consumption.

In an alternative embodiment, the channel control module is configured to set the target voltage of each column line according to the minimum cut-in voltage that can be achieved when each column line provides stable output, thereby further compensating for the consistency under a situation that an image with low gray scale is displayed.

It should be explained that the relationship terms, such as "first" and "second", are used herein only for distinguishing one entity or operation from another entity or operation but do not necessarily require or imply that there exists any actual relationship or sequence of this sort between these entities or operations. Furthermore, terms "comprising", "including" or any other variants are intended to cover the non-exclusive including, thereby making that the process, method, merchandise, or device comprising a series of elements comprise not only those elements but also other elements that are not listed explicitly or the inherent elements to the process, method, merchandise, or device. In the case of no more limitations, the element limited by the sentence "comprising a . . . " does not exclude that there exists another same element in the process, method, merchandise, or device comprising the element.

The embodiments in accordance with the present disclosure, as described above, are not described in detail, and are not intended to limit the present invention to be only the described particular embodiments. Obviously, many modifications and variations are possible in light of the above. These embodiments have been chosen and described in detail by the specification to explain the principles and embodiments of the present disclosure so that those skilled in the art can make good use of the present invention and the modified use based on the present invention. The invention is to be limited only by the scope of the appended claims and the appended claims and equivalents thereof.

What is claimed is:

1. An LED display device, comprising:

a display array, comprising a plurality of row lines, a plurality of column lines, and a plurality of pixel units, wherein each of the plurality of pixel units comprises an LED connected to a corresponding one of the plurality of row lines and a corresponding one of the plurality of column lines;

a row driver module, which is connected to the plurality of row lines and configured to provide selection signals;

a column driver module, which is connected to the plurality of column lines and configured to provide driving signals corresponding to gray scale data according to pulse width modulation signals, respectively; and a channel control module, connected to the plurality of column lines, wherein, the channel control module is configured to adjust a column-line voltage of a corresponding one of the plurality of column lines to a target voltage in a first time period when a corresponding one of the pulse width modulation signals is active, wherein the column driver module is configured to control a constant current source to provide a driving current in a second time period after the first time period, so that LEDs which are comprised by the plurality of LEDs and connected to a corresponding one of the plurality of column lines are turned on to produce luminance corresponding to the gray scale data.

2. The LED display device according to claim 1, wherein the channel control module comprises:

a plurality of buffer amplifiers, each of which comprises a non-inverting input terminal, an inverting input terminal, an enabling terminal and an output terminal, wherein, the non-inverting input terminal is configured to receive the target voltage, the inverting input terminal and the output terminal are connected to a corresponding one of the plurality of column lines, and the enabling terminal is configured to receive an enabling signal.

3. The LED display device according to claim 2, wherein the channel control module further comprises a target voltage generation unit, configured to set the target voltage of the plurality of column lines according to a predetermined value.

4. The LED display device according to claim 2, wherein the channel control module further comprises:

a voltage detection unit, which is connected to the plurality of column lines and configured to obtain a minimum cut-in voltage of each of the plurality of column lines; and a target voltage generation unit, configured to respectively set the target voltage of each of the plurality of column lines according to the minimum cut-in voltage of a corresponding one of the plurality of column lines.

5. The LED display device according to claim 4, wherein the channel control module further comprises a timing generator, configured to generate the enable signal, which is synchronized with the pulse width modulation signal corresponding to each of the plurality of column lines.

6. The LED display device according to claim 1, wherein the display array comprises an LED display array, an AMOLED display array, a MicroLED or a MiniLED display array.

7. A chip of an LED display device, wherein the chip comprises at least one of a row driver module, a column driver module, and a channel control module according to claim 1.

8. A driving method of an LED display device comprising a plurality of row lines, a plurality of column lines and a plurality of pixel units, wherein each of the plurality of pixel units comprises an LED connected to a corresponding one of the plurality of row lines and a corresponding one of the plurality of column lines, wherein the driving method comprises:

generating gray scale data according to an image to be displayed;

generating pulse width modulation signals according to the gray scale data; and adjusting a column-line voltage of a corresponding one of the plurality of column lines to a target voltage in a first time period when a corresponding one of the pulse width modulation signals is active, controlling constant current sources to provide driving currents in accordance with the pulse width modulation signals in a second time period after the first time period, respectively, such that LEDs which are comprised by the plurality of LEDs and connected to a corresponding one of the plurality of column lines are turned on to produce luminance corresponding to the gray scale data.

* * * * *